US005274966A

United States Patent [19]

Daley

[11] Patent Number: 5,274,966

[45] Date of Patent: Jan. 4, 1994

[54] INSULATING COVER FOR ATTIC STAIR OPENING

[76] Inventor: John G. Daley, 2143 Echo La., Wilmington, N.C. 28403

[21] Appl. No.: 863,968

[22] Filed: Apr. 6, 1992

[51] Int. Cl.[5] ..... E04D 13/035; E06C 9/06

[52] U.S. Cl. ..... 52/23; 182/81; 49/386; 52/72

[58] Field of Search ..... ;9/397, 464, 386; 16/385, 386, 390, 392, 260; 52/585, 23, 72; 182/81, 46, 77, 78

[56] References Cited

U.S. PATENT DOCUMENTS

| | | | |
|---|---|---|---|
| 755,122 | 3/1904 | Fisher | 52/585 |
| 2,012,800 | 8/1935 | Allen | 16/385 |
| 4,065,539 | 12/1977 | Nadel | 264/251 |
| 4,115,901 | 9/1978 | Schmidt | 16/386 |
| 4,281,743 | 8/1981 | Fuller | 182/46 |
| 4,550,534 | 11/1985 | Mariano et al. | 52/72 |
| 4,596,098 | 6/1986 | Finkbeiner et al. | 52/239 |
| 4,696,412 | 9/1987 | McGowan et al. | 16/385 |
| 5,037,234 | 8/1991 | De Jong | 52/585 |

*Primary Examiner*—James L. Ridgill, Jr.

*Attorney, Agent, or Firm*—Rhodes, Coats & Bennett

[57] ABSTRACT

The present invention entails an attic stair insulating cover made of a strong, lightweight insulating material such as polyurethane having a first insulating section and a second insulating section that are attachable to form a main insulating section. The insulating cover includes hinge assemblies that mount the insulating cover at the attic stair opening for positioning the attic stair insulating cover between an open and closed position. Each hinge assembly includes a partially hollow hinge arm that is molded onto the insulating cover. A removable axis pin connects the hinge arm to a block mounted adjacent to the attic opening. The hinge assembly axis is horizontally spaced from the main insulating cover and is also vertically spaced above the attic floor. A gasket recess extends along a bottom edge of the insulating cover with a gasket fitted into the recess and extending therefrom. A user positions the attic stair insulating cover by gripping a handle molded onto an inside portion of an insulating cover wall and having a palm rest with indented sections on opposite sides of the palm rest.

8 Claims, 4 Drawing Sheets

INSULATING COVER FOR ATTIC STAIR OPENING

FIELD OF THE INVENTION

The present invention relates generally to insulating covers and more particularly to insulating covers that are positionable over an attic stair opening.

BACKGROUND OF THE INVENTION

Use of an attic stair insulating cover can save money by reducing costly energy from escaping through an attic stair opening. Energy savings accrued through the use of an attic stair insulating cover will obviously be offset by the initial cost of the insulating cover. To recover and significantly profit from their initial investment in the insulating cover, the insulating cover must provide effective insulation during use and must also be both durable and relatively cheap. In addition, once placed in an operational position the attic stair insulating cover should be safe to use.

Several factors impact the effectiveness of an insulating cover in preventing loss of energy through the attic opening. The ability to properly position the insulating cover over the attic stair opening after exiting the attic is one important factor in evaluating the effectiveness of the insulating cover. As disclosed U.S. Pat. No. 4,928,441, issued May 29, 1990, mounting the insulating cover into position over the attic stair opening with hinges that are attached to the cover ensures proper positioning of the insulating cover. Attaching a gasket to the insulating cover, as disclosed in U.S. Pat. No. 4,928,441, also improves the insulation characteristics of an insulating cover by providing a seal between the attic floor surface and the insulating cover.

One problem with insulating covers that have attached hinges and gaskets is that such insulating covers are more expensive to produce. To offset the added expense of adding hinges and gaskets, such insulating cover should be durable to extend its effective life. The durability of an insulating cover mounted to the attic stair opening by hinges is limited by stress placed on the cover during use.

When hinges are attached to an insulating cover with fasteners, such as screws, the opening and closing of the insulating cover causes a repeated torque to be produced where the fastener connects to the insulating cover. This repeated torque on the fasteners causes the fasteners to be pulled loose from the insulating cover. In addition, the extreme temperature ranges in attics cause the insulating cover to expand and contract resulting in the fasteners becoming loosen. The combined effects of repeated opening and closing of the insulating cover and the extreme range of temperatures in an attic result in the hinge fasteners being pulled loose from the insulating cover. Once the hinge fasteners are pulled loose, the integrity of the insulating cover is impaired and the hinges may be inoperable.

One approach to improving the durability of the insulating cover is to strengthen the insulating cover such that the attached hinges will not be pulled loose. The problem with increasing the strength of the cover is that strengthening the cover results in a heavier and/or more expensive cover. A heavier cover is also less manageable for a user to position while maintaining a balanced position on attic stairs. Furthermore, a heavier cover is dangerous if the cover happens to fall on the user or the cover slips from the user's grip during the positioning of the cover.

The durability of a gasket attached to a flat bottom edge of the insulating cover is also susceptible to operating conditions of the cover. The extreme temperature range of an attic causes the gasket to repeatedly contract and expand, reducing the effective life of the gasket. Likewise, during opening and closing the section of the gasket located adjacent to the hinges is in particularly stressed. The repeated stress on the gasket, which is typically attached to a flat surface on the bottom edge of a cover, tends to tear the gasket from the insulating cover. In addition, a gasket attached to a flat bottom will have to support the weight of the cover when the cover is placed in a closed position where the cover's bottom edge rests against the attic floor surface. The placement of the cover's weight against the gasket tends to severely wear the gasket. Gaskets attached to a flat bottom edge, as discussed above, have limited durability and must be replaced at regular intervals to maintain the effectiveness of the insulating cover.

As described above, attaching hinges and gaskets to an insulating cover increases the ability of the cover to provide insulation, but the attached hinges and gaskets decrease the durability of these insulating covers. A more durable cover would help a user recoup the greater initial cost of covers having attached hinges and gaskets.

Safety of a person using an insulating cover is an additional concern in producing an effective insulating cover. In particular, the cover should be designed to help prevent the cover from inadvertently falling from an open position to a closed position. The opening and closing of the insulating cover should also be manageable and safe for all users.

SUMMARY AND OBJECT OF THE INVENTION

The attic stair insulating cover of the present invention is an improvement over prior art attic stair insulating covers. The insulating cover is blow molded with a strong, lightweight insulating material such as polyurethane, and includes first and second mating insulating section that are attachable to form a main insulating member. An extension section is also provided to adjust the length of the main insulating member to accommodate attic stair openings of different size. Hinge assemblies are integrally attached to the main insulating member such that the insulating cover can be pivotally mounted at the attic stair opening. The hinge assemblies have a hollow mold section that is used to integrally mold the hinge assemblies onto the insulating cover. Handles are molded into the insulating cover to provide a durable handle for a user to open and close the attic stair insulating cover. Molding both the hinge assemblies and the handles to the attic stair insulating cover improves the durability of the insulating cover. The insulating cover also includes a gasket recess formed along the bottom edge of the side walls. The gasket recess enables a gasket to be firmly and securely fixed to the insulating cover.

Accordingly, it is an object of the present invention to provide an attic stair insulating cover that is durable.

Another object of the present invention is to provide an insulating cover that is adjustable to fit over different size attic stair openings.

Another object of the present invention is to provide an attic stair insulating cover with hinge assemblies that are molded onto the cover.

Another object of the present invention is to provide a attic stair insulating cove that can be conveniently removed from the attic stair opening after it ha been fixedly mounted at the attic stair opening.

Another object of the present invention is to provide an attic stair insulating cover having a gasket that is more durable and easily replaceable.

Another object of the present invention is to provide an attic stair insulating cover that is mounted to a hinge assembly that prevents the attic stair insulating cover from inadvertently moving from a open position to a closed position.

Another object of the present invention is to provide an attic stair insulating cover that is conveniently and manageably positionable between an open and closed position.

Another object of the present invention is to provide a lightweight attic stair insulating cover that has good insulating characteristics.

Other objects and advantages of the present invention will become apparent and obvious from a study of the following description and the accompanying drawings which are merely illustrative of such invention.

DETAILED DESCRIPTION OF THE INVENTION

Figure 1:
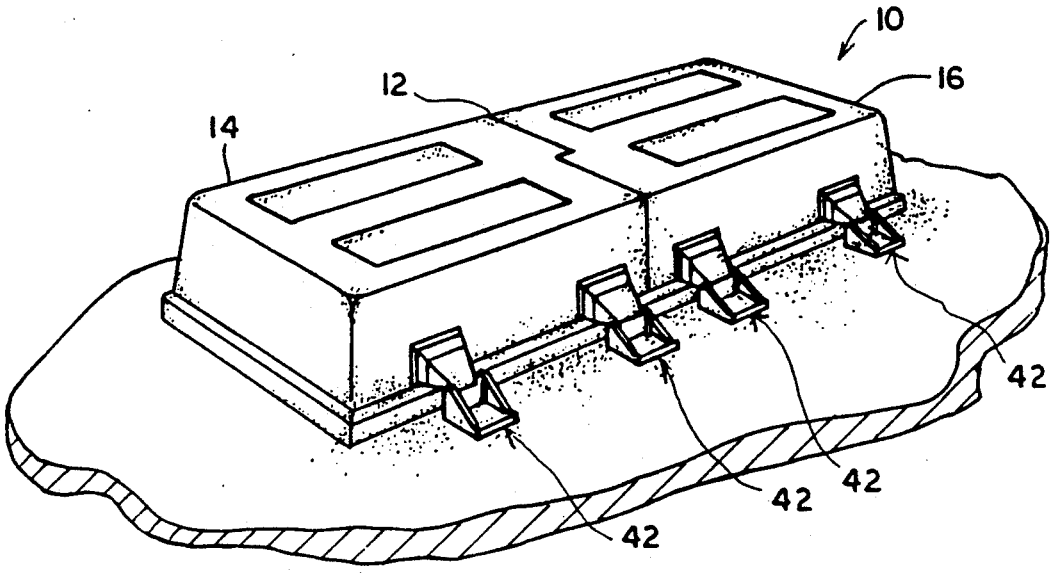
FIG. 1 is perspective view of the attic stair insulating cover in a closed position.

With further reference to the drawings, the attic stair insulating cover of the present invention is shown therein and indicated generally by the numeral 10. Insulating cover 10 includes a main insulating member 12 that is positionable over an attic stair opening, as shown in FIG. 1.

Figure 2:
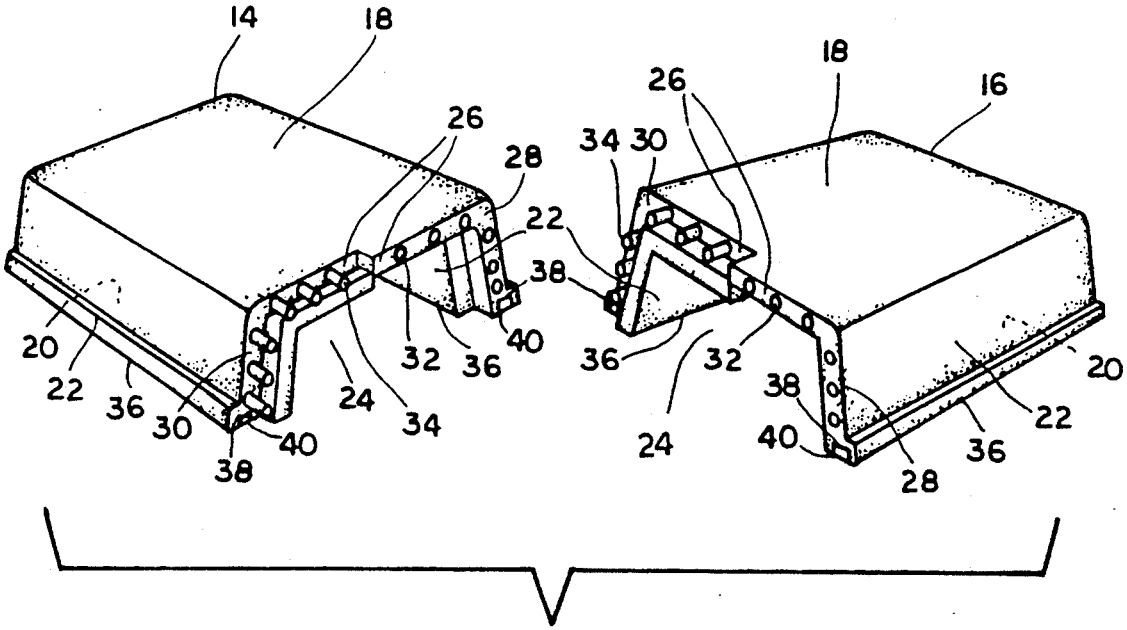
FIG. 2 is perspective view of the first and second insulating sections in a detached position.

Main insulating member 12 is comprised of attachable first and second insulating sections 14 and 16 that are shown in a disassembled position in FIG. 2. First and second insulating sections 14 and 16 are blow molded with an insulating material having sufficient strength to permit attachments to be integrally molded to the main insulating member 12. In the preferred embodiment, the insulating material used is polyurethane.

Insulating sections 14 and 16 each include a closed top 18, an open bottom 20, closed side walls 22 and an open side wall 24. Located along each open side wall 24 is an interface edge 26 designed such that insulating sections 14 and 16 can be fixedly attached together. Interface edge 26 includes a projected section 28 and an indented section 30. Molded into closed top 18 and a closed side wall 22 are inserts cups 32 that open at projected section 28 of interface edge 26. Mating plugs 34 are likewise molded into the closed top 18 and a closed side wall 22 and extend outwardly from the indented section 30 of interface edge 26.

Insert cups 32 and mating plugs 34 provide an attachment means for attaching together first insulating section 14 and second insulating section 16. When first and second insulating sections 14 and 16 are orientated as generally shown in FIG. 2, the first and second insulating sections 14 and 16 can be pressed together such that mating plugs 34 are inserted into insert cups 32. In this manner, the indented section 30 and projected section 28 of the first insulating section 14 are mated to the opposing projected section 28 and indented section 30 of second insulating section 16.

Located at the lower portion of closed side walls 22 is a bottom contact edge 36. Bottom contact edge 36 extends around the open bottom 20. Also formed in the lower portion of the closed side walls is a gasket recess 38. Gasket recess 38 extends from the bottom contact edge 36 upward into closed side walls 22. Adhesively attached within the gasket recess 38 is a gasket 40. Gasket 40 is a rubber material that extends outwardly from the bottom contact edge surface 36 when in an uncompressed state. Gasket 40 is compressible such that the portion of the gasket that extends outwardly form the bottom contact edge 36 is compressible into the gasket recess 38.

As shown in FIG. 1, four separate hinge assemblies 42 are fixed along one side of main insulating member 12. Each insulating section 14 and 16 has one hinge assembly 42 fixed adjacent to interface edge 26 and a second hinge assembly 42 fixed towards the opposite end of the closed side wall 22.

Figure 3:
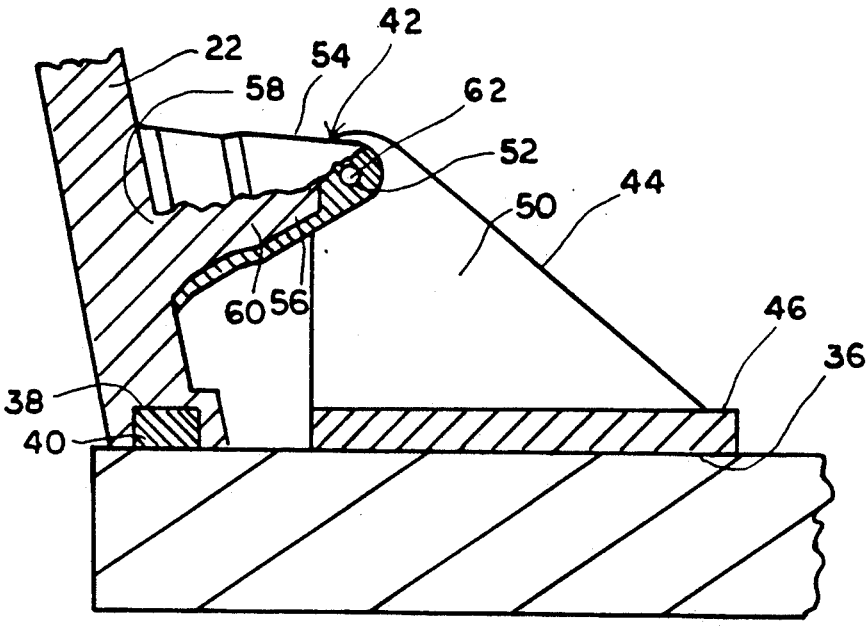
FIG. 3 is a side elevational view of the hinge assembly attached to the insulating cover and with a cut-away of the hinge arm illustrating the mold section of the hinge arm.

Each hinge assembly 42, as shown in exploded view illustrated in FIG. 3, includes a block member 44, a hinge arm 54, and an axis pin 62. Block member 44 includes a base section 46 having a pair of extension sections 50 extending vertically upwards from base section 46. Axis openings 52 extend in a generally horizontal direction through the pair of extension sections 50.

Extending horizontally through one end of hinge arm 54 is an opening that when properly aligned with extension sections 50, forms a part of axis opening 52. Hinge arm 54 is pivotally mounted to block 44 by an axis pin 62 that is insertable through axis opening 52. Hinge arm 54 is positionable between a mounted and unmounted position by inserting and removing pin 62 from axis opening 52. At the opposite end of the hinge arm 54 is a mold opening 58 that leads to a hollow mold section 56 located within hinge arm 54. A mold member 60 extends from the mold opening 58 and into mold section to integrally attach the hinge arm 54 to main insulating member 12. More particularly, during the molding process of first and second insulating sections 14 and 16, the polyurethane used for forming insulating sections 14 and 16 is injected through mold opening 58 and fills mold section 56 such that upon cooling a mold member 60 integral with the insulating members 12 and 14 is extended into mold section 56 such that hinge arm 54 is integrally attached to side wall 22. Because polyurethane is a sturdy material hinge arm is securely fixed to side wall 22 without use of attachment screws.

Figure 5:
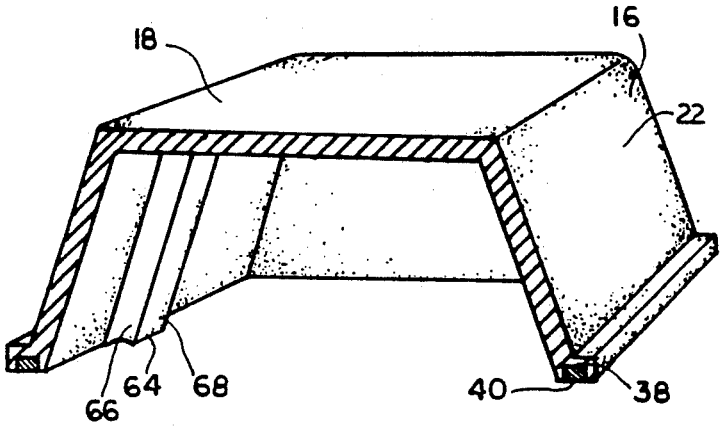
FIG. 5 is a cross-sectional view of the present invention attic stair insulating cover of the present invention illustrating the cover's handle.

Handles 64 are also molded into a closed side wall 22 of each insulating section 14 and 16, as shown in FIG. 5.

Handle 64 is constructed of a plastic material and includes flat palm section 68 and finger indentation areas 66 which are located on opposite sides of palm section 68.

Figure 4:
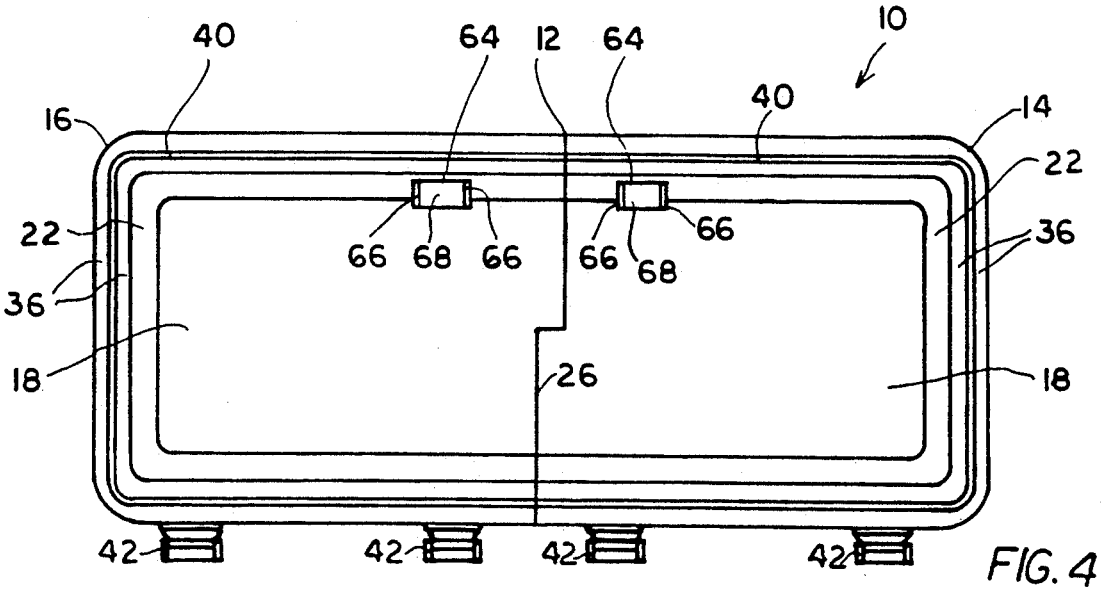
FIG. 4 is a bottom plan view of the present invention attic stair insulating cover.

As shown in FIG. 4, a handle 64 is located on both the first insulating section 14 and the second insulating section 16. Attaching two handles 64 at different locations on the main insulating member 12 is important to the safety of a user. Depending on which side of the attic stair opening that the insulating cover 10 is mounted, one particular handle 64 will be more accessible than the other handle 64. Without the location of two positionally displaced handles 64 on the main insulating member, a user may have to dangerously stretch in an attempt to grip a handle 64 and position insulating cover 10. Being forced to unnecessarily reach for a handle 64 inconveniently located increases the danger of the user falling from the attic stair opening.

Figure 6:
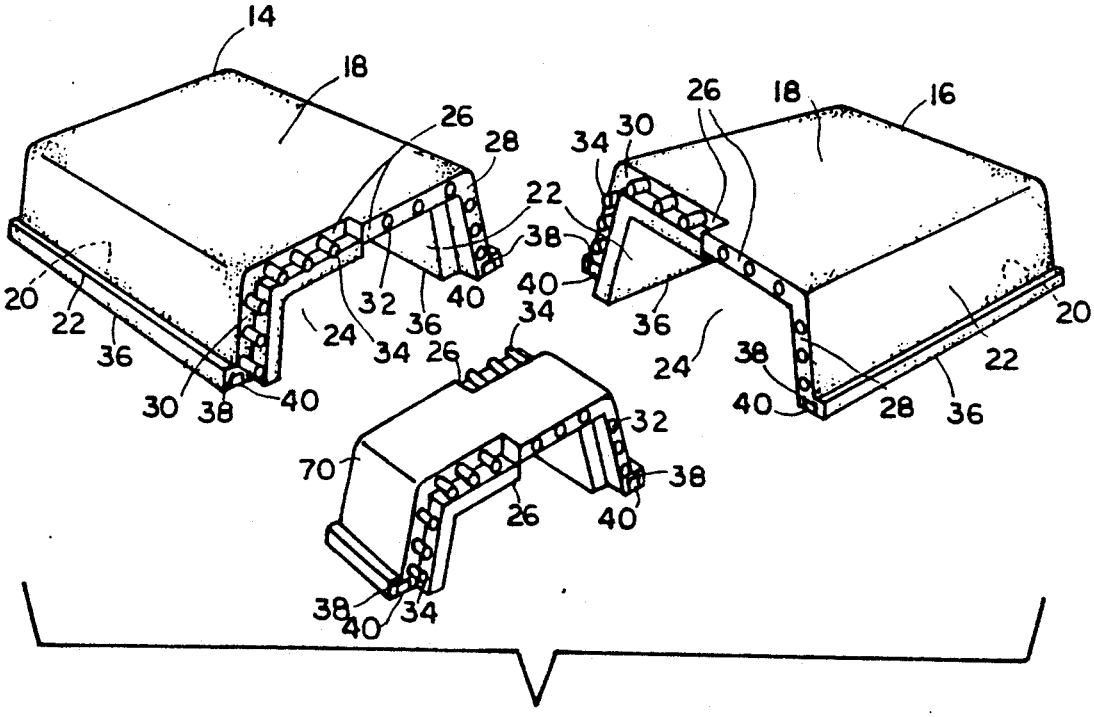
FIG. 6 is a perspective view of the first and second insulating sections and the extension section in a detached position.

An extension member 70, shown in FIG. 5, can be used to adjust the length of main insulating member 12. Extension member 70 is constructed with the same materials and in the same manner as first and second insulating sections 14 and 16. Extension member 70 includes a gasket recess 38, gasket 40 and interfacing edges 72. Interface edges 72 are designed to mate with the interfacing edges 26 of the first and second insulating sections 14 and 16. As shown in FIG. 6, extension member 70 is fitted between first and second insulating sections 14 and 16 and attaches these two sections 14 and 16 together. Extension member 7 is used when the attic stair opening is larger than a standard attic stair opening.

Insulating cover 10 is designed to be easily assembled and placed into operational position in an attic after shipping. Consumer assembly of insulating cover will ordinarily be required because reduce shipping costs insulating cover 10 is preferably packaged and shipped in a disassembled position. To prepare the insulating cover 10 for use, the first and section insulating sections 14 and 16 are generally orientated as shown in FIG. 2, and then pressed together such that the insert cups 32 and mating plugs 34 on opposing interface edges 26 fix the first and second insulating sections 14 and 16 together to form main insulating member 12.

Base section 46 of the hinge assemblies 42 are then aligned adjacently to the attic opening. Base sections 46 are then fixed to the attic floor with screws or similar fasteners. Once base sections 46 have been properly aligned and fixed to the attic floor surface, the main insulating member 12 is positioned such that the hinge arms 54 are properly aligned with the base sections 46. Axis pin 62 is then inserted into axis opening 52 which extends through extension section 50 and hinge arm 54 to pivotally connect block 44 with hinge arm 54. Removable axis pin 62 allows main insulating member 12 to be conveniently attached and detached from block 44 without the need of removing or unscrewing the base section 46 of block 44 which has been fixedly attached to the attic floor.

Figure 7:
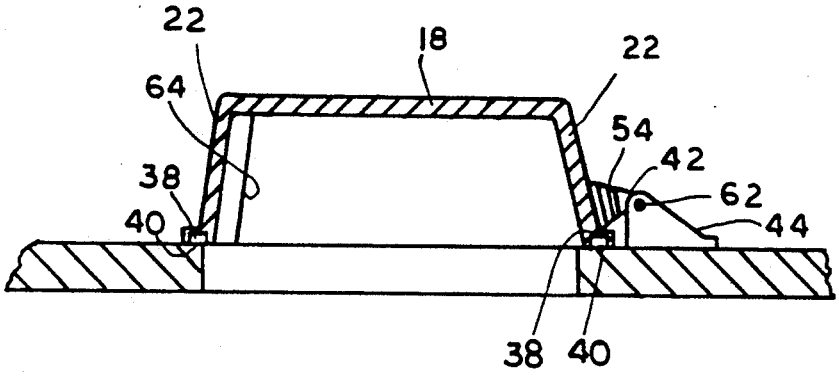
FIG. 7 is a cross-sectional view of the attic stair insulating cover in a closed position.

Once attic stair opening cover 10 has been installed at the attic stair opening, the main insulating member 12 is positionable between a closed position shown in FIG. 6 and an open position shown in FIG. 7. In particular, a user grips the handle 64 which is most conveniently located to the user and positions the main insulating member 12 such that the bottom contact edge 36 lies adjacent to the attic floor. The insulating member 12, made from polyurethane, weighs about 13–15 lbs. and is easily manageable by a user.

Figure 8:
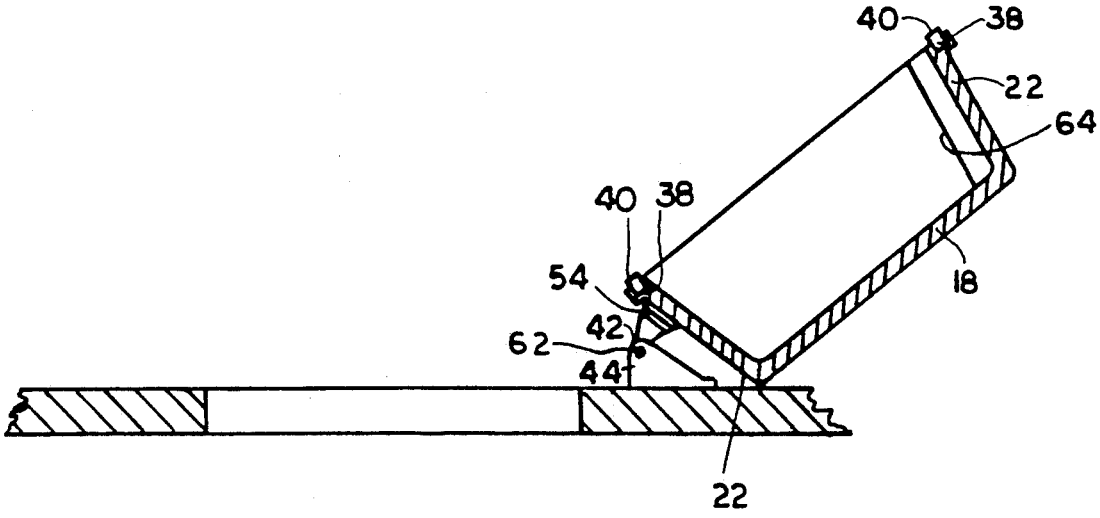
FIG. 8 is cross-sectional view of the attic stair insulating cover in an open position.

The weight of the main insulating member 12, when in this closed position, forces the compressible gasket 40 upwards into gasket recess 38, as shown in FIG. 7. The elasticity of gasket 40 forces gasket 40 against the attic floor to form a seal between main insulating member 12 and the attic floor. Because gasket 40 has been compressed into gasket recess 38, the weight of main insulating member 12 is primarily supported by the bottom contact edge 36. The support of the weight of the main insulating member 12 on the bottom contact edge 36 as opposed to gasket 40 reduces the stress on gasket 40 and improves the life duration of gasket 40. Further, gasket recess 38 provides both bottom and side support to gasket 40 to help prevent the unwanted detachment of gasket 40 from main insulating member 12. As shown in FIG. 8, when in the closed position, gasket 40 is uncompressed and extends outward from bottom contact edge 36.

To position attic insulating cover 10 in an open position in order to access the attic through the attic opening, the user grips handle 64 and pushes upwards. The upward force exerted on the main insulating member 12 causes main insulating member 12 to pivot into an open position, as shown in FIG. 8. Because insulating member 12 is pivotally opened the user does not have to actually lift the full weight of insulating member 12 during the opening and closing of cover 10. A substantial portion of the weight of insulating member 12 is supported by hinge assemblies 42. As the insulating member 12 moves from a closed position to an open position, an increasingly greater portion of the insulating member's weight is supported by hinge assemblies 42. Therefore, the force that a user must exert to position insulating member 12 decreases as the insulating member 12 moves from a closed position to an open position. At no time during the opening and closing of insulating member 12 will the user be required to lift more than approximately half of the insulating member's full weight. A pivotally mounted insulating member 12 results in an easily manageable cover 10.

The pivot axis of hinge assembly 42 formed by axis pin 62 is vertically positioned above the attic by extension section 50. As shown in FIG. 6, positioning axis pin 62 at an elevated position places main insulating member 12 in a more stable open position. Because of the elevated position of axis pin 62 main insulating member 12 is tilted backwards such that side wall 22 attached to hinge arm 54 in the preferred embodiment, forms approximately a forty-five degree angle with the attic floor surface, as shown in FIG. 8. The elevational positioning of axis pin 62 may be varied for different embodiments of hinge assembly 42, but the elevational position of axis pin 62 will preferably result in the main insulating member 12 being tilted backwards such that the side wall 22 attached to hinge arm 54 forms an angle with the attic floor of at least ten degrees. By forming an angled open position, insulating member 12 is less likely to inadvertently fall from an open position to a closed position. Without an elevated hinge arm axis, a side wall of the main insulating member would lie flat against the attic floor and not be as safe.

Axis pin 62 is also horizontally displaced from the main insulating member 12 to help prevent gasket 40 from being unnecessarily rubbed against the attic floor surface as the main insulating member 12 is positioned from the closed position to an open position. The horizontal displacement increases the arc of rotation of the insulating cover to relieve stress placed on the gasket 40 when the insulating cover 12 is opened. To close main insulating member, a user grips handle 64 and controllably pulls main insulating member 12 to a closed position. Hinge assemblies 42 insures that main insulating member 12 is properly positioned about the attic stair opening upon closing.

If a user desires to remove the main insulating member 12 from the attic stair opening, axis pin 62 is removed from axis opening 52 and then the main insulating member 12 with the attached hinge arm 54 can be moved out of the way of the attic stair opening.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An attic stair opening insulating cover covering and forming a generally air-tight seal about an attic floor and around an attic opening in the floor comprising:

(a) a main insulating member having a closed top and a surrounding wall having a bottom contact edge;

(b) a gasket recess formed completely around the bottom contact edge and including a gasket cavity that projects into the contact edge and forms a gasket channel extending completely around the bottom contact edge so as to define a contact surface around the contact edge and on opposite sides of the gasket cavity; and (c) a compressible gasket secured within the gasket cavity and in a noncompressed mode extending form the gasket cavity past the contact surface such that the gasket itself projects past the contact edge and surface thereof, and wherein when the insulating member assumes a closed position the portion of the gasket projecting from the gasket cavity extends into contact with the attic floor surrounding the attic opening and at least partially compresses and supports the insulating member over the attic opening and seals the insulating member to the attic floor and wherein the compressed gasket and adjacent contact surface form a generally flush sealed surface with the attic floor.

2. The insulting cover of claim 1 wherein the insulating cover comprises a molded cover having a pair of integral molded hinge arms formed therewith and projecting form the molded cover, and a hinge block adapted to be fixed to the attic floor adjacent the attic opening, and wherein each integral molded hinge arm is pivotally connected to the hinge block and pivots about a pivot axis such that the insulating cover can be moved between open and closed positions.

3. The insulating cover of claim 2 wherein each hinge arm includes a core material that forms a molded integral part of the cover.

4. The insulating cover of claim 3 wherein the hinge arm pivot axis is spaced substantially above the attic floor such that as the insulating cover is raised, the gasket moves upward of the attic floor without substantial lateral movement of the gasket with respect to the attic floor so as to prevent wear and tear of the gasket during opening.

5. An attic stair opening insulating cover covering and forming a generally air-tight seal about an attic floor and around an attic opening in the floor comprising:

(a) a molded insulating member having a top and surrounding side wall having a bottom contact edge for engaging the attic floor around the attic opening;

(b) a compressible gasket projecting from the bottom contact edge for forming a generally air-tight seal around the attic opening;

(c) a pair of integrally molded hinge arms that are integral with the molded insulating member and project therefrom such that the molded insulating member and integral hinge arms form a unitary molded structure;

(d) a hinge block secured to the attic floor surrounding the attic opening for pivotally supporting the molded integral hinge arms; and (e) wherein the hinge arm pivot axis is spaced substantially above the attic floor when the cover is mounted above the attic stair opening so that the cover is constrained to move upwards from the attic floor without any significant lateral movement of the gasket across the floor as the cover is pivoted form a closed position to an open position.

6. The insulating cove of claim 5 wherein each molded hinge arm includes an outer casing and a core that is integrally molded to the insulating member.

7. The insulating cove of claim 5 wherein there is formed an indented gasket channel in the bottom contact edge of the insulating member and wherein the gasket channel actually projects into the contact edge and forms a continuous gasket extending channel around the entire contact edge of the cover, and wherein on opposite sides of the gasket channel there are defined contact surfaces; and a compressible gasket secured within the gasket channel completely around the contact edge and wherein the gasket projects form the gasket channel past the opposed contact surfaces, wherein in the closed position the gasket comprises such that both the gasket and contact surfaces form a generally flush and airtight fit with attic floor so as to seal the insulating member with the attic floor and to effectively seal the attic opening in such a manner that the weight of the insulating cover is carried by both the compressible gasket and opposed contact surfaces when the insulating cover is in the closed position.

8. A multi-piece molded adjustable insulating cover adapted to fit various size attic stair openings, comprising:

(a) a first molded cover section having an interfacing edge;

(b) a second molded over section having an interfacing edge;

(c) said first and second molded over sections being substantially similar in shape and design;

(d) first coupling means for attaching the first and second cover sections together at the interfacing edges such that an insulating cover is formed; and (e) an intermediate extension section having opposing interacting edges and second coupling means found on the interacting edges for connecting the intermediate extension section between the first and second cover sections so as to form an insulating cover adapted to fit over a larger size attic stair opening.

* * * * *